US007446274B2

(12) United States Patent
Choi et al.

(10) Patent No.: US 7,446,274 B2
(45) Date of Patent: Nov. 4, 2008

(54) KEYPAD ASSEMBLY FOR ELECTRONIC EQUIPMENT AND METHOD THEREOF

(76) Inventors: Jae-young Choi, c/o Samsung Advanced Institute of Technology, San 14-1 Nongseo-dong, Giheung-gu, Yongin-si, Gyeonggi-do (KR); Joo-hoon Lee, c/o Samsung Advanced Institute of Technology, San 14-1 Nongseo-dong, Giheung-gu, Yongin-si, Gyeonggi-do (KR); Hyeon-jin Shin, c/o Samsung Advanced Institute of Technology, San 14-1 Nongseo-dong, Giheung-gu, Yongin-si, Gyeonggi-do (KR)

( * ) Notice: Subject to any disclaimer, the term of this patent is extended or adjusted under 35 U.S.C. 154(b) by 0 days.

(21) Appl. No.: 11/772,362

(22) Filed: Jul. 2, 2007

(65) Prior Publication Data

US 2008/0087533 A1 Apr. 17, 2008

(30) Foreign Application Priority Data

Oct. 11, 2006 (KR) ..... 10-2006-0098864

(51) Int. Cl.
*H01H 9/18* (2006.01)

(52) U.S. Cl. ..... 200/310; 200/314

(58) Field of Classification Search ..... 200/310–317; 341/22, 28; 345/168–172; 400/472, 485, 400/486, 487

See application file for complete search history.

(56) References Cited

U.S. PATENT DOCUMENTS

| | | | | |
|---|---|---|---|---|
| 5,950,809 | A * | 9/1999 | Andre | 200/314 |
| 6,605,789 | B2 * | 8/2003 | Chen et al. | 200/310 |
| 6,608,271 | B2 * | 8/2003 | Duarte | 200/311 |
| 6,734,382 | B2 * | 5/2004 | Arai et al. | 200/512 |
| 6,805,506 | B2 * | 10/2004 | Bar-Yona | 400/485 |
| 6,860,612 | B2 * | 3/2005 | Chiang et al. | 362/29 |
| 7,186,935 | B2 * | 3/2007 | Lee et al. | 200/310 |
| 7,244,899 | B2 * | 7/2007 | Jung et al. | 200/314 |
| 7,294,802 | B2 * | 11/2007 | Yurochko | 200/310 |
| 7,294,803 | B2 * | 11/2007 | Lee et al. | 200/314 |

* cited by examiner

*Primary Examiner*—Michael A Friedhofer
(74) *Attorney, Agent, or Firm*—Cantor Colburn LLP

(57) ABSTRACT

A keypad assembly of electronic equipment includes a plurality of light emitting units, a light guide plate guiding light emitted from the light emitting units, a plurality of key buttons formed on a top surface of the light guide plate and including numeral and character key plates, a plurality of reflection patterns formed on the light guide plate and reflecting light toward the key buttons, a plurality of protrusions formed under the reflection patterns, a switch substrate including a plurality of switches corresponding to the protrusions, a first optical filter layer formed under the numeral key plates and converting the light emitted from the light emitting units into light of various colors according to wavelengths of the light emitted from the light emitting units, and a second optical filter layer formed under the character key plates and blocking violet wavelength light and transmit light having other wavelengths.

20 Claims, 8 Drawing Sheets

KEYPAD ASSEMBLY FOR ELECTRONIC EQUIPMENT AND METHOD THEREOF

This application claims priority to Korean Patent Application No. 10-2006-0098864, filed on Oct. 11, 2006, and all the benefits accruing therefrom under 35 U.S.C. §119, the contents of which are incorporated herein in its entirety by reference.

BACKGROUND OF THE INVENTION

1. Field of the Invention

The present invention relates to a keypad assembly for electronic equipment, and more particularly, to a keypad assembly for electronic equipment, in which an optical filter layer is formed at a key button so as to selective emit light in response to the wavelength of light irradiated to the optical filter layer.

2. Description of the Related Art

Portable communication devices include portable devices that can be used for wireless communications. Such a portable communication device includes a keypad as a data input unit. A user can input data to the portable communication device by pressing a button of the keypad using a finger.

FIG. 1 is a cross-sectional view illustrating a conventional keypad assembly 10.

Referring to FIG. 1, the conventional keypad assembly 10 includes a light emitting unit 20, a light guide plate 30 guiding light emitted from the light emitting unit 20, a plurality of key buttons 40 formed on a top surface of the light guide plate 30 and including printed numeral and character key surfaces, a plurality of protrusions 50 protruded from a bottom surface of the light guide plate 30 in correspondence with the key buttons 40, a plurality of reflection patterns 31 formed on the bottom surface of the light guide plate 30 in correspondence with the key buttons 40 so as to direct the light guided by the light guide plate 30 toward the key buttons 40, and a switch substrate 60 disposed under the protrusions 50 and including a plurality of dome switches 61 corresponding to the protrusions 50.

Light (B) emitted from the light emitting unit 20 is guided by the light guide plate 30 and reflected by the reflection patterns 31. Thus, the light (B) can be directed to the key buttons 40 so as to illuminate the numeral and character key surfaces of the key buttons 40.

In this case, although the entire key buttons 40 can be illuminated using the single light emitting unit 20 and the light guide plate 30, the numeral and character key surfaces of the key buttons 40 cannot be separately illuminated.

BRIEF SUMMARY OF THE INVENTION

An exemplary embodiment provides a keypad assembly for electronic equipment, the keypad assembly including an optical filter layer selectively emitting light according to the wavelength of light irradiated onto the optical filter layer so as to selectively illuminate character and numeral keys depending on the operation mode of the electronic equipment.

In an exemplary embodiment, there is provided a keypad assembly for electronic equipment. The keypad assembly includes a plurality of light emitting units generating light, a light guide plate through which light emitted from the light emitting units proceeds, a plurality of key buttons disposed on a top surface of the light guide plate, each of the key buttons including a numeral key plate and a character key plate, a plurality of first reflection patterns formed on the light guide plate and configured to reflect light toward the first key buttons, a plurality of first protrusions disposed under the first reflection patterns, a switch substrate including a plurality of switches corresponding to the protrusions, a first optical filter layer disposed under the numeral key plates of the first key buttons and configured to convert the light emitted from the light emitting units into a first light of a first color according to wavelengths of the light emitted from the light emitting units, and a second optical filter layer disposed under the character key plates of the key buttons and configured to block violet wavelength light and transmit light having other wavelengths.

An exemplary embodiment of a method of illuminating a keypad assembly for electronic equipment includes generating a first light of a plurality of light emitting units of the keypad assembly, guiding the first light through a light guide plate and toward a plurality of key buttons of the keypad assembly, each of the key buttons including a first image plate and a second image plats, a first reflection pattern reflecting the guided light toward the key buttons of the keypad assembly, the first reflection patterns disposed on the light guide plate and corresponding to the key buttons, a first optical layer converting the first light to a second light of a first color according to a wavelength of the first light generated, the first optical layer being disposed between the first image plates and the light guide plate of the keypad assembly, and a second optical filter layer blocking a violet wavelength and transmitting non-violet wavelengths, the second optical filter layer being disposed between the second image plates and the light guide plate of the keypad assembly. An exemplary embodiment of a method of forming a keypad assembly of an electronic equipment includes disposing a plurality of light generating units at an incident side of a light guide plate, the light generating units emitting a first light, disposing a plurality of first key buttons on a top surface of the light guide plate, each of the first key buttons including a first image plate and a second image plate, forming a first reflection pattern on the light guide plate and corresponding to each of the first key buttons, disposing a first optical layer between each of the first image plates of the first key buttons and the light guide plate, the first optical layer being configured to convert the first light emitted from the light generating units into a second light of a first color according to a wavelength of the first light, and disposing a second optical layer between each of the second image plates of the first key buttons and the light guide plate, the second optical layer being configured to absorb a violet-wavelength light and transmit light having other wavelengths.

BRIEF DESCRIPTION OF THE DRAWINGS

The patent or application file contains at least one drawing executed in color. Copies of this patent or patent application publication with color drawings will be provided by the Office upon receipt and payment of the necessary fee.

The above and other features and advantages of the present invention will become more apparent by describing in detail exemplary embodiments thereof with reference to the attached drawings in which.

DETAILED DESCRIPTION OF THE INVENTION

Figure 1:
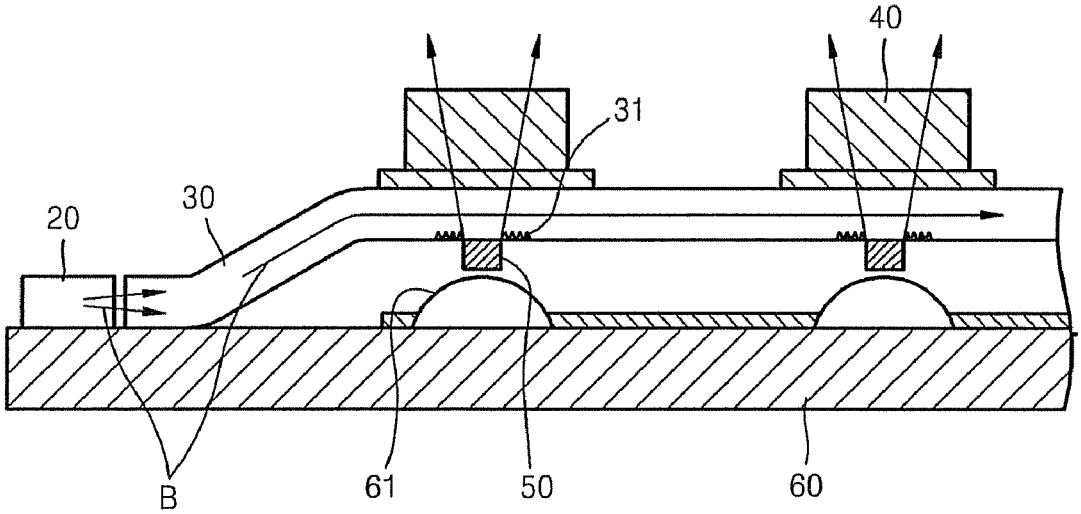
FIG. 1 (PRIOR ART)
FIG. 1 is a cross-sectional view illustrating a conventional keypad assembly.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "under" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be described in detail with reference to the accompanying drawings.

Figure 2:
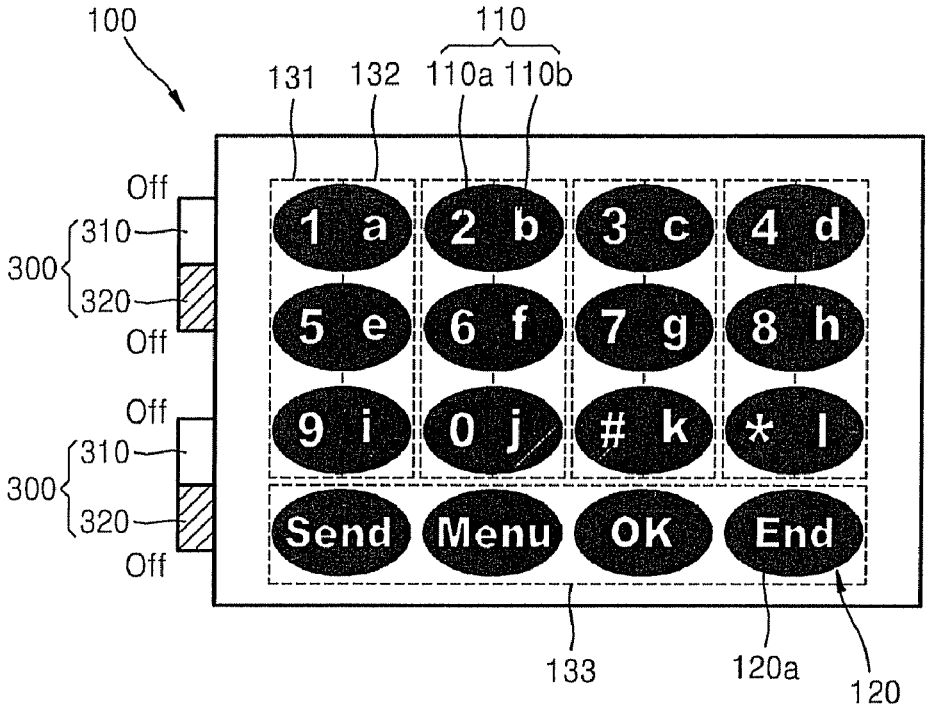
FIG. 2 is a plan view illustrating an exemplary embodiment of a keypad assembly for electronic equipment according to the present invention.
Figure 3:
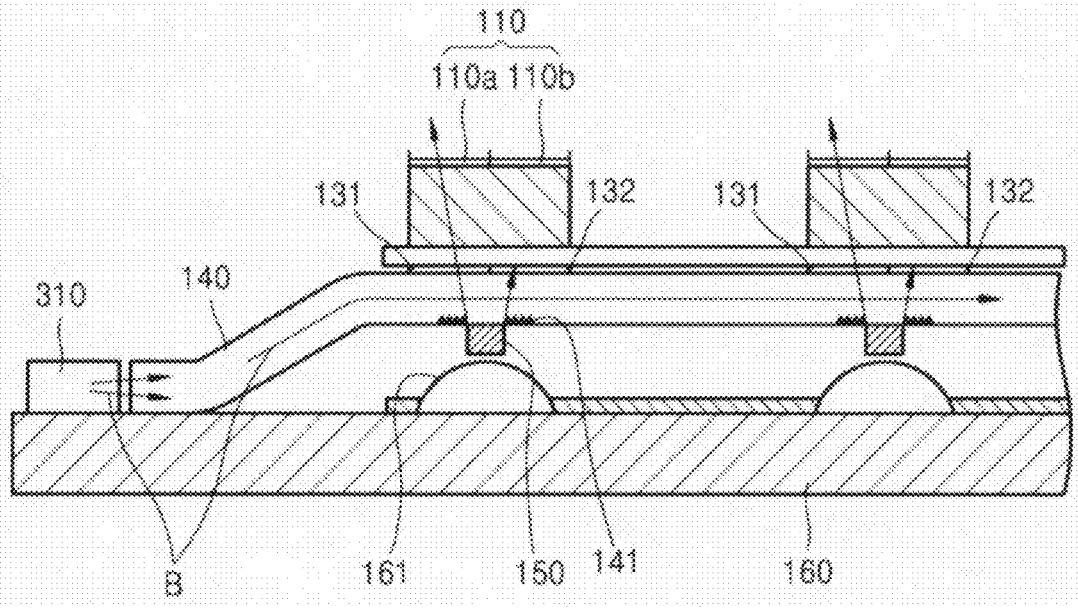
FIG. 3 is a cross sectional view illustrating an exemplary embodiment of the keypad assembly of FIG. 2 when a first light emitting unit is turned on according to the present invention.
Figure 4:
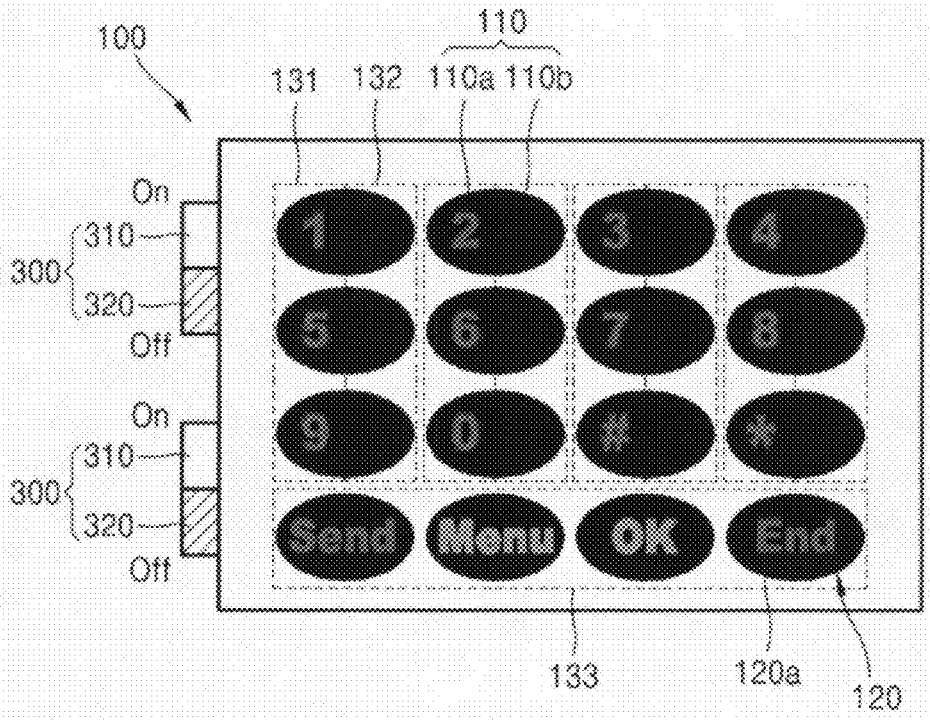
FIG. 4 is a plan view illustrating the keypad assembly of FIG. 2 when the first light emitting unit is turned on according to the present invention.
Figure 5:
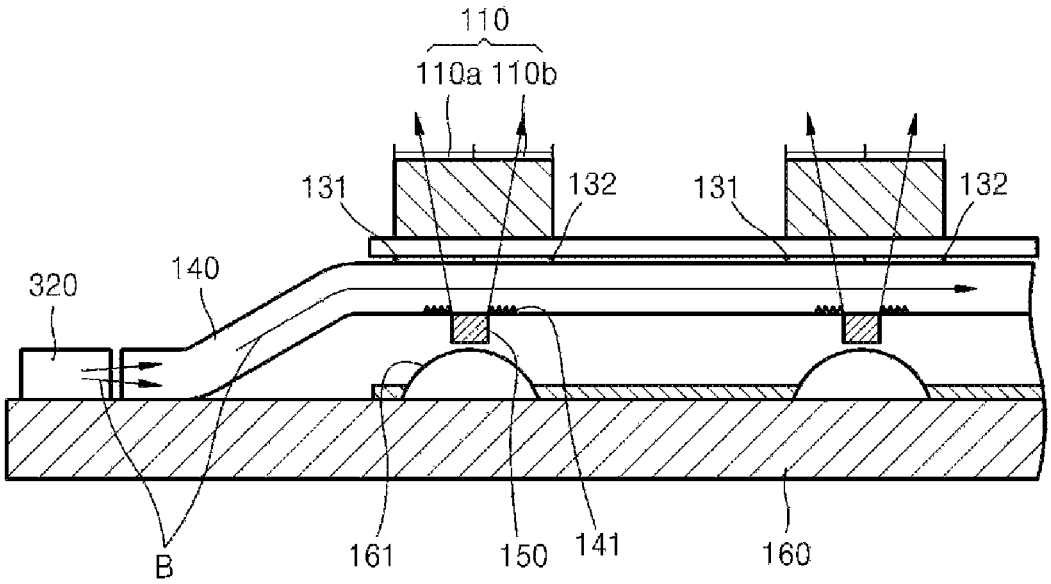
FIG. 5 is a cross sectional view illustrating an exemplary embodiment of the keypad assembly of FIG. 2 when a second light emitting unit is turned on according to the present invention.
Figure 6:
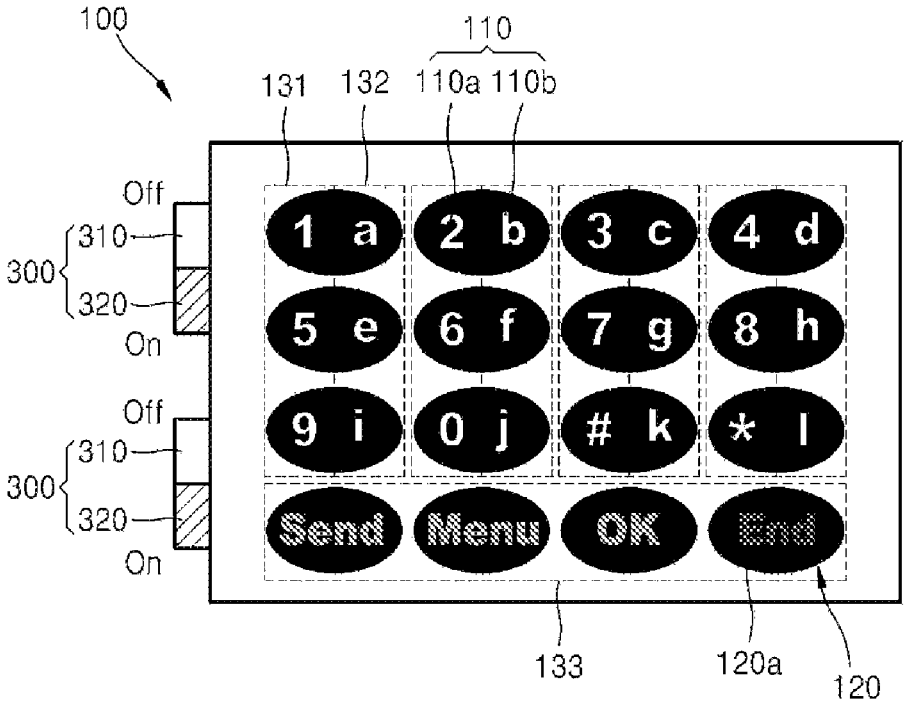
FIG. 6 is a plan view illustrating the keypad assembly of FIG. 2 when the second light emitting unit is turned on according to the present invention.

FIG. 2 is a plan view illustrating an exemplary embodiment of a keypad assembly for electronic equipment according to the present invention, FIG. 3 is a cross sectional view illustrating an exemplary embodiment of the keypad assembly of FIG. 2 when a first light emitting unit 310 is turned on according to the present invention, FIG. 4 is a plan view illustrating the keypad assembly of FIG. 2 when the first light emitting unit 310 is turned on according to the present invention, FIG. 5 is a cross sectional view illustrating an exemplary embodiment of the keypad assembly of FIG. 2 when a second light emitting unit 320 is turned on according to the present invention, and FIG. 6 is a plan view illustrating the keypad assembly of FIG. 2 when the second light emitting unit 320 is turned on according to the present invention.

Referring to FIGS. 2 and 3, the keypad assembly includes a keypad 100, light emitting units 300, a light guide plate 140, a plurality of key buttons 110, a first optical filter layer 131, a second optical filter layer 132, a third optical filer layer 133, a plurality of reflection patterns 141, a plurality of protrusions 150, and a switch substrate 160 having a plurality of switches 161.

A keypad 100 includes key buttons 110 supported on the keypad 100. In an exemplary embodiment, the key buttons 110 may be arranged at predetermined intervals on a top surface of the keypad 100.

The light emitting units 300 generate and emit light. The light emitting units 300 may be disposed at one side of the keypad 100, e.g. a transverse side of the keypad 100. Each of the light emitting units 300 includes a first and a second light emitting unit 310 and 320. As in the illustrated embodiment, each of the light emitting units 300 includes one of the first and second light emitting units 310 and 320, but the invention is not limited thereto.

The first light emitting unit 310 may emit light having a center wavelength in the range of about 370 nanometers (nm) to about 450 nanometers (nm). In one exemplary embodiment, the first light emitting unit 310 may emit light having a center wavelength in the range of about 400 nm to about 420 nm.

The wavelength bandwidth of the first light emitting unit 310 may be determined by a type and grade of a light source used for the first light emitting unit 310. In an exemplary embodiment, when a light emitting diode ("LED") is used for the first light emitting unit 310, the wavelength bandwidth of the first light emitting unit 310 may range from about ±10 nm to about ±60 nm. Violet light emitted from the first light emitting unit 310 may have a wavelength in the range of about 400 nm to about 420 nm, or relatively broadly in the range of about 370 nm to about 450 nm. The wavelength of violet light emitted from the first light emitting unit 310 can vary according to the center wavelength and wavelength bandwidth of the first light emitting unit 310.

In exemplary embodiments, an LED having a center wavelength of about 400 nm may be used for the first light emitting unit 310. Advantageously, deterioration of components of the keypad assembly due to light having a wavelength shorter than about 400 nm can be reduced or effectively prevented.

In an exemplary embodiment, the second light emitting unit 320 emits white light. The first and second light emitting units 310 and 320 may be selectively turned on to illuminate the keypad 100 according to the illumination mode of electronic equipment employing the keypad assembly. The light emitting unit 300 may be formed of a plurality of LEDs, such as greater than two and suitable for the purpose described herein.

The light guide plate 140 guides light generated from the light emitting unit 300 toward a bottom side of the keypad 100.

The key buttons 110 are mounted on the top surface of the keypad 100. Each of the key buttons 110 may include a numeral key plate 110*a* and a character key plate 110*b*. As in the illustrated embodiment, special key buttons 120 which may include a plurality of special word key plates 120*a* may be disposed under the key buttons 110, e.g., such as along a longitudinal side of the keypad 100 and "under" the key buttons 110 as in the plan view of FIG. 2. The key buttons may also include any of a number of images, text, symbols, alphanumeric characters as is suitable for use of the electronic device.

The first, second, and third optical filter layers 131,132, and 133 are interposed between the keypad 100 and the light guide plate 140, and correspond with the key buttons 110 and the special key buttons 120, respectively. As used herein, "correspond" is used to indicate corresponding substantially in shape, size or positional placement. As in the illustrated embodiment, the first optical filter layer 131 corresponds to the numeral key plates 110*a* of the keypad 100, the second optical filter layer 132 corresponds to the character key plates 110*b* of the keypad 100, and the third optical filer layer 133 corresponds to the special word plates 120*a* of the special key buttons 120.

In the illustrated embodiment, the first optical filter layer 131 is formed using red (R), green (G), and blue (B) phosphors. The first optical filter layer 131 can emit light of various colors by luminescence using the red (R), green (G), and blue (B) phosphors. In other words, the first optical filter layer 131 may emit light of various colors depending on the wavelengths of light emitted from the first and second light emitting units 310 and 320.

The second optical filter layer 132 blocks violet wavelength light emitted from the first light emitting unit 310 but transmits light having other wavelengths. In an exemplary embodiment, the second optical filter layer 132 may be formed of a material absorbing violet wavelength light and transmitting light having other wavelengths.

Figure 7:
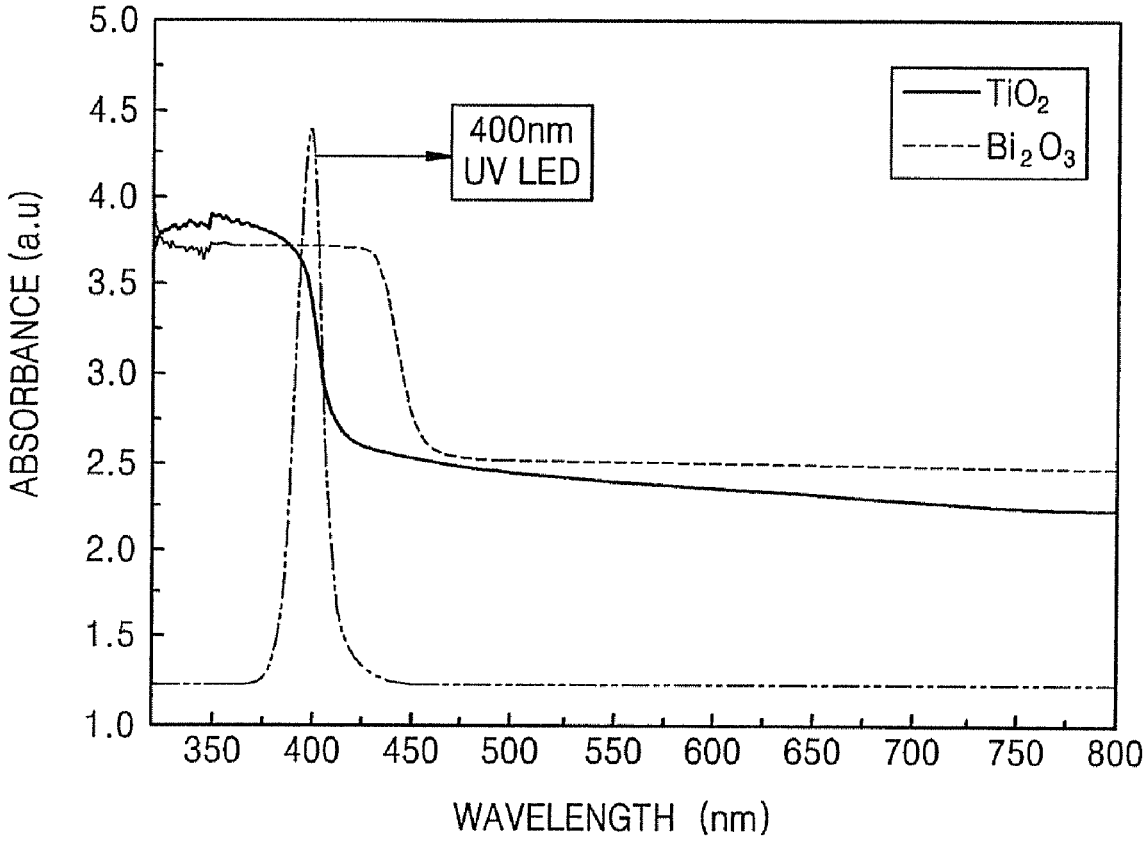
FIG. 7 is a graph illustrating an exemplary embodiment of an absorbance versus a wavelength of a titanium oxide and a bismuth trioxide.

FIG. 7 is a graph illustrating an exemplary embodiment of absorbance in angstrom units (a.u) of a titanium oxide ($TiO_2$) and a bismuth trioxide ($Bi_2O_3$) as a function of ultraviolet wavelength.

Although the absorbance of titanium oxide ($TiO_2$) decreases when the wavelength increases above about 400 nm, the absorbance of bismuth trioxide ($Bi_2O_3$) remains at a good level even when the wavelength ranges from about 400 nm to about 450 nm.

In the illustrated embodiment, the center wavelength of the first light emitting unit 310 is about 400 nm (e.g., ranges from about 380 nm to about 420 nm). The first light emitting unit 310 emits violet light having a wavelength in the range of 400 nm to 420 nm. Thus, bismuth trioxide ($Bi_2O_3$) may be used for the second optical filter layer 132 to absorb (e.g., block) violet light emitted from the first light emitting unit 310. Since bismuth trioxide ($Bi_2O_3$) is yellow in color, the bismuth trioxide ($Bi_2O_3$) transmits only a yellow wavelength when receiving white light. Thus, titanium oxide ($TiO_2$) can be used as a material transmitting white light.

In an exemplary embodiment, the second optical filter layer 132 can be formed using bismuth trioxide ($Bi_2O_3$) for absorbing violet light and titanium oxide ($TiO_2$) for transmitting white light. When bismuth trioxide ($Bi_2O_3$) and titanium oxide ($TiO_2$) are used together for the second optical filter layer 312, light transmitted through the optical filter layer 132 is colored less yellow as compared with the case where bismuth trioxide ($Bi_2O_3$) is used alone.

The composition ratio of bismuth trioxide ($Bi_2O_3$) to titanium oxide ($TiO_2$) is important for the second optical filter layer 132 to block violet light and transmit white light according to the present invention.

A composition ratio of bismuth trioxide ($Bi_2O_3$) to titanium oxide ($TiO_2$) can be demonstrated through the following experiments.

Predetermined amounts of cyclohexanone, titanium oxide ($TiO_2$), and bismuth trioxide ($Bi_2O_3$) were mixed with a binder and rolled three to five times using a three-roller mill so as to prepare a paste mixture.

The mixture ratio of binder was: cyclohexanone:titanium oxide ($TiO_2$) and bismuth trioxide ($Bi_2O_3$) was 50%:25%:25% by atomic percent. Here, the ratio of titanium oxide ($TiO_2$):bismuth trioxide ($Bi_2O_3$) was 1:1 or 1:2.

A second optical filter layer was formed by silk-screen printing using the paste mixture, and then violet-blocking and white-transmitting properties of the second optical filter layer were evaluated.

Figure 8:
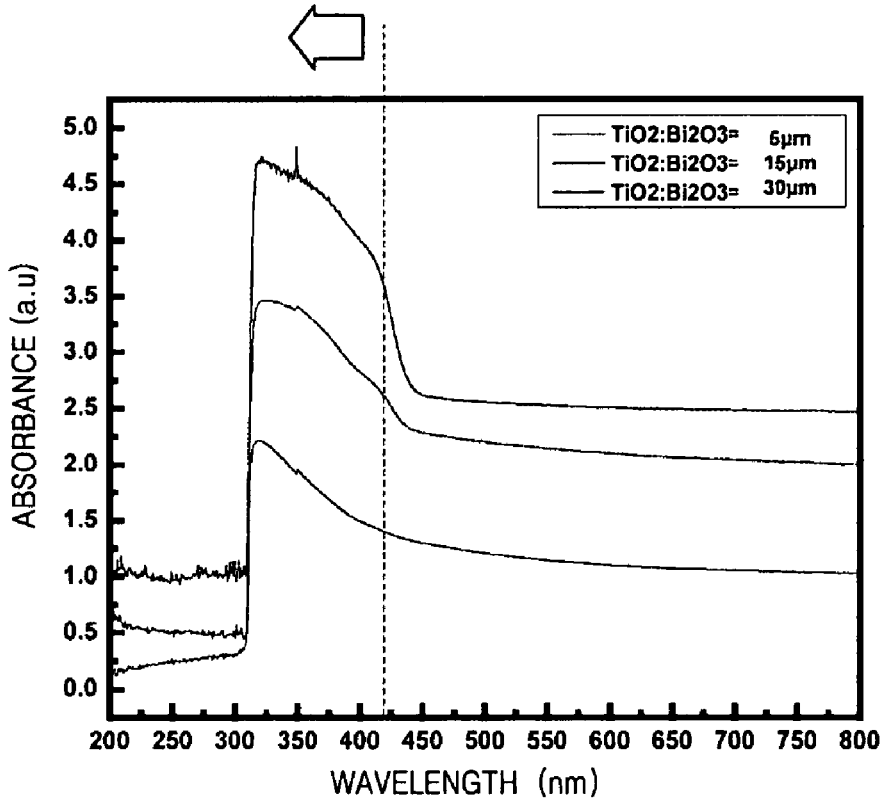
FIG. 8 is a graph illustrating an exemplary embodiment of the optical absorbance of a 1:1 mixture of titanium dioxide ($TiO_2$) and bismuth trioxide ($Bi_2O_3$) mixture for different thickness of the mixture.

FIG. 8 is a graph illustrating the optical absorbance of a 1:1 mixture of titanium oxide ($TiO_2$) and bismuth trioxide ($Bi_2O_3$) for different thicknesses of the mixture. The optical absorbance of the mixture increases with increasing thickness of the mixture.

FIGS. 9A through 9D are graphs for explaining violet light blocking property of a second optical filter layer with respect to the composition and thickness of the second optical filter layer.

Figure 9A:
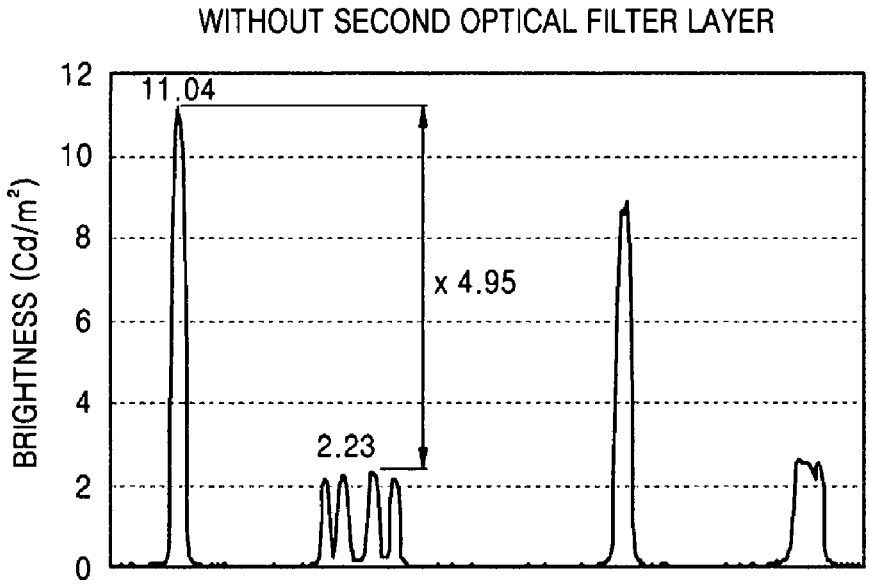
FIGS. 9A through 9D are graphs for explaining an exemplary embodiment of a violet light blocking property of a second optical filter layer with respect to the composition and thickness of the second optical filter layer according to the present invention.

Experiments were performed to evaluate the light blocking property of the second optical filter layer formed on a keypad. FIG. 9A is obtained from the case where a first optical filter layer 131 is formed by printing red phosphor for 1 and 2 keys and yellow-green phosphor for "E", "R", "T", and "Y" keys, and a second optical filter layer 132 is not formed for "@" and "$" keys.

Figure 9B:
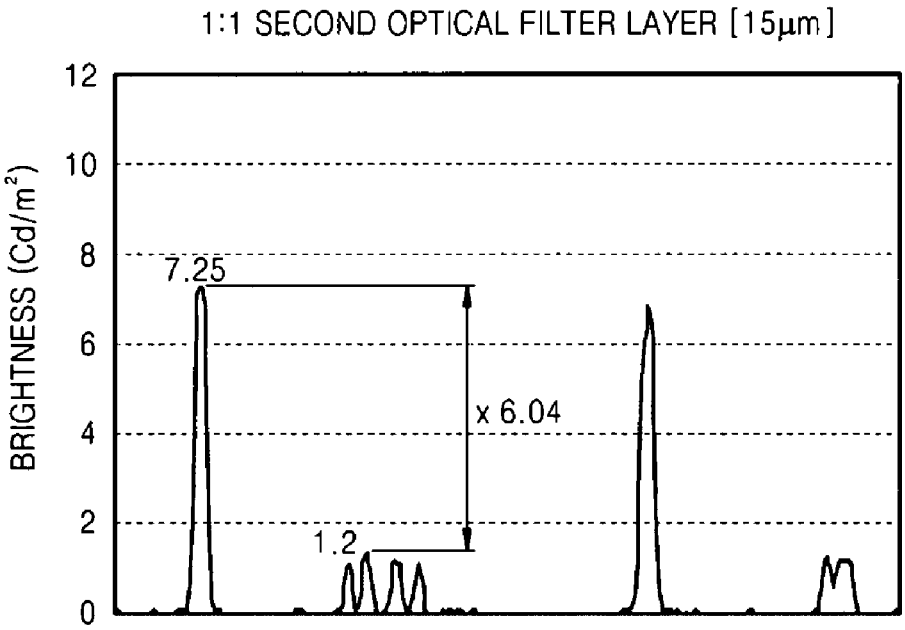
Figure 9C:
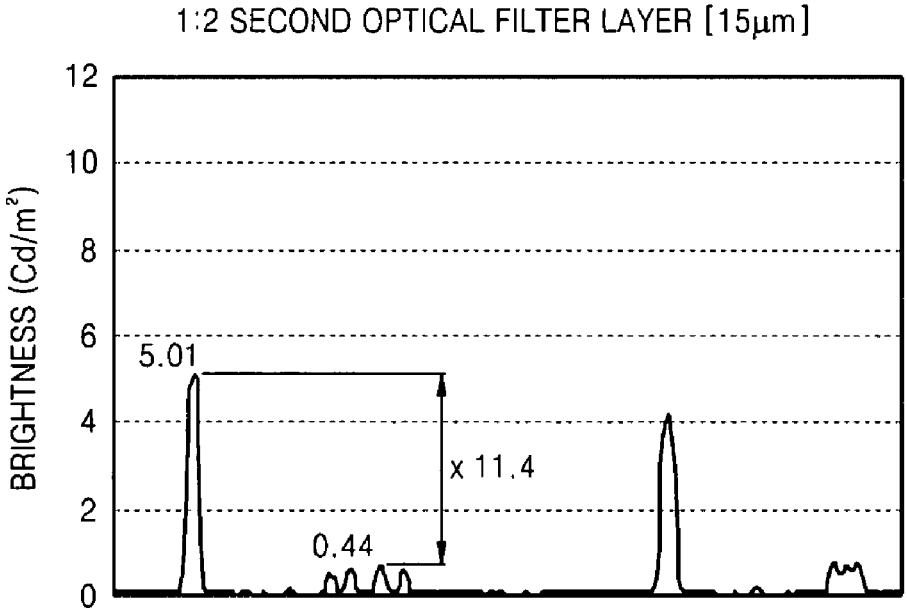
Figure 9D:
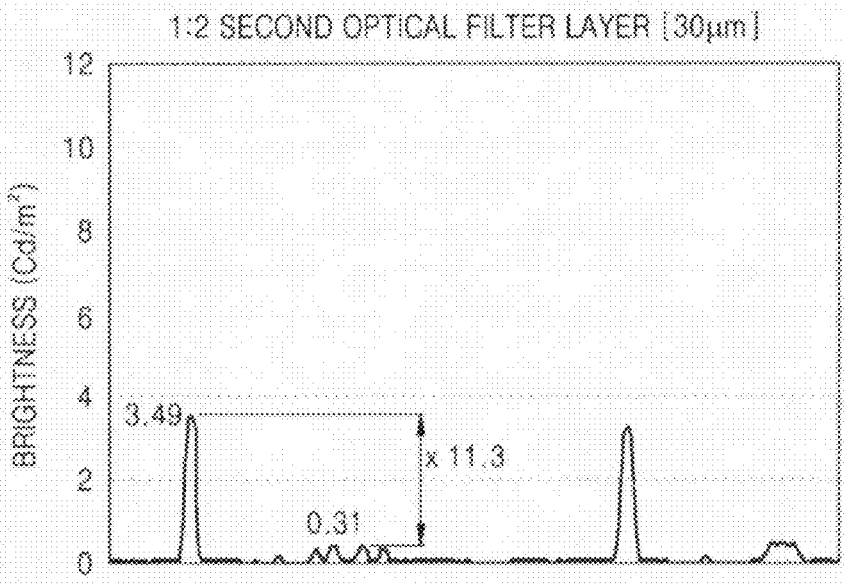

FIG. 9B is obtained from the case where a 1:1 mixture of titanium oxide ($TiO_2$) and bismuth trioxide ($Bi_2O_3$) is printed to a thickness of 15 microns (μm) as a second optical filter layer 132. FIG. 9C is obtained from the case where a 1:2 mixture of titanium oxide ($TiO_2$) and bismuth trioxide ($Bi_2O_3$) is printed to a thickness of 15 μm as a second optical filter layer 132. FIG. 9D is obtained from the case where a 1:2 mixture of titanium oxide ($TiO_2$) and bismuth trioxide ($Bi_2O_3$) is printed to a thickness of 30 μm as a second optical filter layer 132.

In the graphs of FIGS. 9A through 9D, second and fourth peaks represent the violet light blocking property of the second optical filter layer 132.

Referring to FIG. 9A, violet light is transmitted through a keypad by 2.23 candela per square meter (cd/$m^2$) when a second optical filter layer 132 is not formed on the keypad. Referring to FIG. 9B, the brightness of light transmitted through a keypad is 1.2 cd/$m^2$ in the case where a 1:1 mixture of titanium oxide ($TiO_2$) and bismuth trioxide ($Bi_2O_3$) is printed on the keypad to a thickness of 15 μm as a second optical filter layer 132. That is, in this case, violet light is effectively blocked. Referring to FIG. 9C, the brightness of light transmitted through a keypad is 0.44 cd/$m^2$ in the case where a 1:2 mixture of titanium oxide ($TiO_2$) and bismuth trioxide ($Bi_2O_3$) is printed on the keypad to a thickness of 15 μm as a second optical filter layer 132. That is, in this case, violet light is blocked more effectively than in the case of FIG. 9B. That is, although the thickness of the second optical filter layer 132 is not increased, the violet light blocking ability of the second optical filter layer 132 can be increased by increasing the amount of the bismuth trioxide ($Bi_2O_3$) in the mixture of the titanium oxide ($TiO_2$) and bismuth trioxide ($Bi_2O_3$).

Furthermore, referring to FIG. 9D, the brightness of light transmitted through a keypad is 0.31 cd/$m^2$ in the case where a 1:2 mixture of titanium oxide ($TiO_2$) and bismuth trioxide ($Bi_2O_3$) is printed on the keypad to a thickness of 30 μm as a second optical filter layer 132. That is, in this case, violet light is blocked more effectively than in the case of FIG. 9C.

Therefore, the light blocking ability of the second optical filter layer 132 can be increased by increasing the thickness of the second optical filter layer 132 and/or the amount of bismuth trioxide ($Bi_2O_3$). In exemplary embodiments, when the second optical filter layer 132 of is formed on a keypad of a portable terminal, the second optical filter layer 132 may be configured to block light to the extent that the brightness of light transmitted through the keypad is 1.0 cd/$m^2$ or less, since a light blocking ability perceived by a user of the portable terminal is important.

Figure 10A:
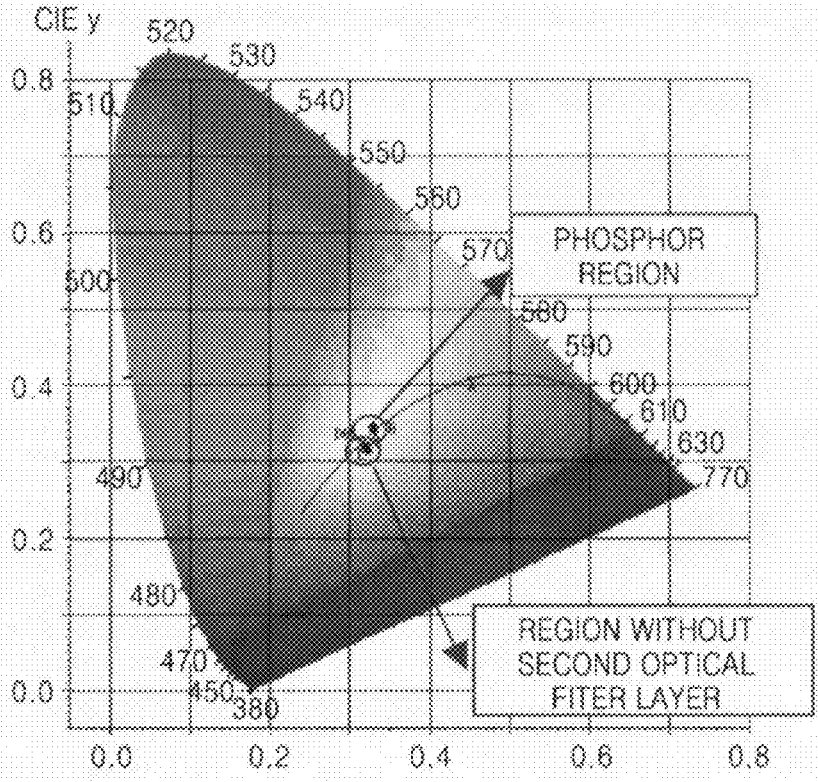
FIGS. 10A and 10B are exemplary embodiments of white light transmittance graphs respectively obtained without a second optical filter layer and with a 30-μm second optical filter layer formed of a 1:2 mixture of titanium dioxide ($TiO_2$) and bismuth trioxide ($Bi_2O_3$) according the present invention.
Figure 10B:
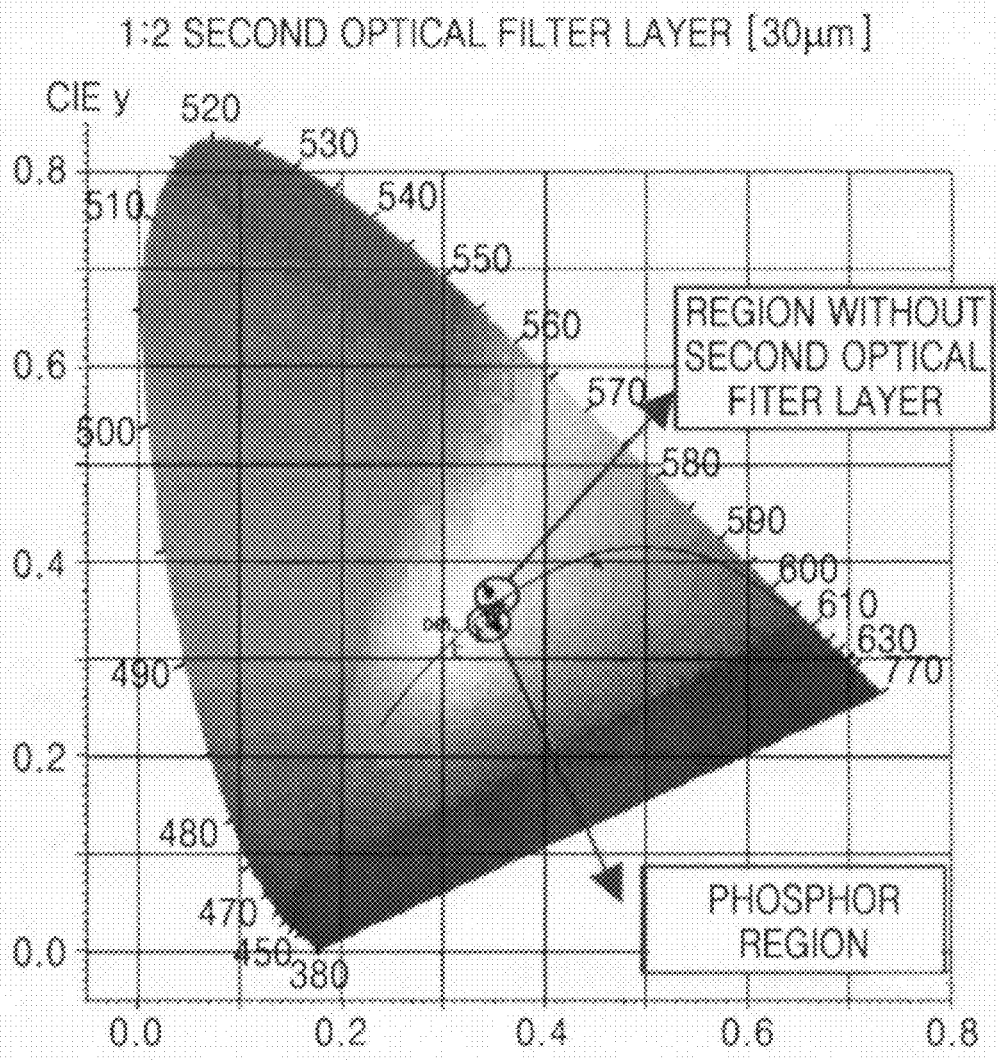

FIG. 10A is an exemplary embodiment of a white light transmittance graph obtained without a second optical filter layer 132, and FIG. 10B is an exemplary embodiment of a white light transmittance graph obtained when a 30-μm layer formed of a 1:2 mixture of titanium oxide ($TiO_2$) and bismuth trioxide ($Bi_2O_3$) is used as a second optical filter layer 132 according to the present invention.

In the illustrated embodiment, yellow light and/or other colored light should not be released from the second optical filter layer 132 when white light is irradiated to the second optical filter layer 132. To evaluate the effects of the present invention, white light transmitting characteristics were analyzed using chromaticity coordinate in the case where the second optical filter layer 132 was not used (FIG. 10A), in comparison with the case where a 30-μm layer formed of a 1:2 mixture of titanium oxide ($TiO_2$) and bismuth trioxide ($Bi_2O_3$) was used as the second optical filter layer 132 (FIG. 10B).

When embodiments of the present invention are applied to a portable terminal, it is important that a user of the portable terminal does not perceive a change in white light after the white light passes through a keypad of the portable terminal. For this, white light should be within CIE x: 0.25-0.40, y: 0.25-0.4 in a chromaticity coordinate after the light passes through a keypad on which a second optical filter layer 132 is not formed (FIG. 10A) or passes through a keypad on which a second optical filter layer 132 is formed (FIG. 10B).

Referring to FIGS. 10A and 10B, when phosphors were used for a first optical filter layer 131, the quality of white light passed through the first optical filter layer 131 was not changed. When a 30-μm layer formed of a 1:2 mixture of titanium oxide ($TiO_2$) and bismuth trioxide ($Bi_2O_3$) was used as the second optical filter layer 132, the quality of white light was acceptable since the white light was within CIE x: 0.25-0.40, y: 0.25-0.4 in the chromaticity coordinate after the white light passed through the second optical filter layer 132.

Table 1 below shows results of experiments performed for evaluating violet light blocking and white light transmitting properties of the second optical filter layer 132 with respect to the composition ratio and thickness of the second optical filter layer 132.

TABLE 1

| Sample No | Composition ratio ($TiO_2$:$Bi_2O_3$) | Thickness (μm) | Brightness (cd/m2) | White light quality |
|---|---|---|---|---|
| 1 | 0:0 | | 2.23 | Good |
| 2 | 0:1 | 15 | 0.01 | Bad |
| 3 | 1:0.5 | 15 | 1.6 | Good |
| 4 | 1:0.5 | 30 | 1.3 | Good |
| 5 | 1:1 | 5 | 1.6 | Good |
| 6 | 1:1 | 15 | 1.2 | Good |
| 7 | 1:1 | 30 | 0.5 | Good |
| 8 | 1:2 | 15 | 0.44 | Good |
| 9 | 1:2 | 30 | 0.31 | Good |
| 10 | 1:4 | 15 | 0.29 | Good |
| 11 | 1:4 | 30 | 0.15 | Good |
| 12 | 1:8 | 15 | 0.16 | Good |
| 13 | 1:8 | 30 | 0.06 | Good |
| 14 | 1:50 | 15 | 0.01 | Bad |
| 15 | 1:50 | 30 | 0.01 | Bad |

In an exemplary embodiment, when violet wavelength light is well blocked by the second optical filter layer 132, the brightness of other wavelength light transmitted through the second optical filter layer 132 should be lower than 1.0 cd/$m^2$. When white light is transmitted through the second optical filter layer 132 at a predetermined quality level, the transmitted white light should be within CIE x: 0.25-0.40, y: 0.25-0.4.

To evaluate violet light blocking characteristics of the second optical filter layer 132, the brightness of light transmitted through the second optical filter layer 132 was measured while varying the composition ratio and thickness of the second optical filter layer 132. The quality of white light transmitted through the second optical filter layer 132 was determined as relatively "good" when the white light transmitted through the second optical filter layer 132 was within CIE x:0.25-0.4, y:0.25-0.4 and as relatively "bad" when the white light transmitted through the second optical filter layer 132 was not within CIE x:0.25-0.4, y:0.25-0.4.

In the case where a second optical filter layer 132 was not used (sample 1), violet light was transmitted although white light quality was good. In the case where a second optical filter layer 132 was formed of only bismuth trioxide ($Bi_2O_3$) (sample 2), white light quality was bad although violet light was fairly well blocked.

In the case where a 30-μm layer formed of a 1:1 mixture of bismuth trioxide ($Bi_2O_3$) and titanium oxide ($TiO_2$) was used as a second optical filter layer 132 (sample 7), violet light was well blocked and white light quality was good.

When the violet light blocking property and white light quality of the second optical filter layer 132 were measured while varying the titanium oxide ($TiO_2$):bismuth trioxide ($Bi_2O_3$) ratio of the second optical filter layer 132 from 1:1, 1:2, 1:4, to 1:8, both the violet blocking property and white light quality were acceptable. However, when the titanium oxide ($TiO_2$):bismuth trioxide ($Bi_2O_3$) ratio was increased to 1:50, the white light quality was bad although the violet light blocking property was good since the amount of bismuth trioxide ($Bi_2O_3$) was relatively too large as compared with the amount of titanium oxide ($TiO_2$).

Meanwhile, the above-described mixture ratio of binder: cyclohexanone: titanium oxide ($TiO_2$) and bismuth trioxide ($Bi_2O_3$) is not limited to the above mentioned ratio. That is, the mixture ratio of binder: cyclohexanone: titanium oxide ($TiO_2$) and bismuth trioxide ($Bi_2O_3$) can vary.

Referring again to FIGS. 2-6, the third optical filter layer 133 may be formed in substantially the same way as the first optical filter layer 131 so as to exhibit different color light depending on the wavelength of light emitted from the first and second light emitting unit 310 and 320, respectively.

The reflection patterns 141 are disposed on the light guide plate 140 and corresponding with the key buttons 110 and the special key buttons 120 so as to direct light from the light guide plate 140 to the key buttons 110 and the special key buttons 120.

The protrusions 150 are disposed on a bottom surface of the light guide plate 140 and corresponding with the key buttons 110 and the special key buttons 120. When the key buttons 110 and the special key buttons 120 are pressed (e.g., in a direction towards the light guide plate 140), the protrusions 150 make contact with the switches 161 so as to turn on the switches 161.

The switch substrate 160 is disposed under the light guide plate 140 and includes the switches 161 corresponding to the protrusions 150.

An exemplary embodiment of an operation of the above-described keypad assembly will now be described with reference to the accompanying drawings.

Referring to FIG. 2, the key buttons 110 and the special key buttons 120 are illuminated (e.g., denoted by the numerals, characters and text being a white color). However, when the first and second light emitting units 310 and 320 are turned off, the key buttons 110 and the special key buttons 120 are not illuminated (e.g., will be shown as black).

Referring to FIGS. 3 and 4, when the first light emitting unit 310 is turned on and an LED generates light having a center wavelength, such as of about 400 nm (e.g., for violet light), the light emitted from the LED proceeds through the light guide plate 140 and is reflected by the reflection patterns 141 toward the key buttons 110. The first optical filter layer 131 responds to the ultraviolet wavelength of the light emitted from the LED of the first light emitting unit 310 so as to illuminate the numeral key plates 110*a* with red light, e.g., shown as gray in FIG. 4. Light is transmitted through the first optical filter layer 131 after being reflected by the reflection patterns, e.g., indicated by arrows in FIG. 3. In the illustrated embodiment, the second optical filter layer 132 including bismuth trioxide ($Bi_2O_3$) absorbs violet light to reduce or effectively prevent the violet light from passing through the second optical filter layer 132. Therefore, the character key plates 110*b* are not illuminated, e.g., shown as black in FIG. 4, as light is not transmitted through the second optical filter layer 132 after being reflected by the reflection patterns, e.g., indicated by arrows in FIG. 3.

When the first light emitting unit 310 is turned on, only the numeral key plates 110*a* are illuminated with red (or pink) light, and the character key plates 110*b* are not illuminated. In an exemplary embodiment, since the third optical filter layer 133 can be illuminated in the same manner as the first optical filter layer 131, the numeral key plates 110*a* and the special word plates 120*a* can be illuminated when the first light emitting unit 310 is turned on (e.g., shown as gray/non-black in FIG. 4). A configuration where only first (e.g., numeral) and/or second (e.g., special word plates) are selectively illuminated may be used as a "numeral illumination mode" for inputting information, such as a phone number or numerals.

Referring to FIGS. 5 and 6, when the second light emitting unit 320 is turned on and generates white light, the white light proceeds along the light guide plate 140 and is reflected by the reflection patterns 141 toward the key buttons 110. When the first optical filter layer 131 receives the incident white light emitted from the second light emitting unit 320, the first optical filter layer 131 illuminates the numeral key plates 110*a* with white light by luminescence (e.g., shown as white in FIG. 6). In an exemplary embodiment, since the third optical filter layer 133 can be illuminated in the same manner as the first optical filter layer 131, the numeral key plates 110*a* and the special word plates 120*a* can be illuminated when the second light emitting unit 320 is turned on (e.g., shown as gray/non-black in FIG. 6).

In the illustrated embodiment, when the second optical filter layer 132 receives the incident white light emitted from the second light emitting unit 320, the second optical filter layer 132 transmits the white light to illuminate the character key plates 110*b* since bismuth trioxide ($Bi_2O_3$) does not respond to the white light and titanium oxide ($TiO_2$) transmits white light (e.g., shown as white in FIG. 6).

Therefore, when the second light emitting unit 320 is turned on, the numeral key plates 110*a*, the character key plates 110*b* and/or the special word plates 120 may be illuminated with white light. A configuration where first (e.g., numeral), second (e.g., special word plates) and/or third (e.g., character) are illuminated at the same time may be used as an illumination mode for sending a message, such as requiring characters and numerals.

As in the illustrated embodiment of FIGS. 4 and 6, the optical filter layers may be configured and/or materials may be selected so as to illuminate predetermined keys at a same or varying brightness. FIGS. 4 and 6 illustrates the numerical key plates 110*a* at a slightly different brightness than the special word plates 120*a* are illuminated.

As in the illustrated embodiments, in a keypad assembly for electronic equipment, different optical filter layers are used for the numeral key plates and character key plates. The optical filter layer for the character key plates is provided for blocking violet wavelength light and transmitting light having other wavelengths so as to illuminate the character key plates with white light. Therefore, illumination modes of the keypad assembly can be distinguished more easily and key plates can be selectively illuminated according to the modes of the keypad assembly.

What is claimed is:

1. A keypad assembly for electronic equipment, the keypad assembly comprising:

a plurality of light emitting units generating light;

a light guide plate through which a first light emitted from the light emitting units proceeds;

a plurality of first key buttons disposed on a top surface of the light guide plate, each of the first key buttons including a numeral key plate and a character key plate;

a plurality of first reflection patterns disposed on the light guide plate and configured so as to reflect light toward the first key buttons;

a plurality of first protrusions disposed under the first reflection patterns;

a switch substrate including a plurality of switches corresponding to the first protrusions;

a first optical filter layer disposed between the numeral key plates of the first key buttons and the light guide plate, the first optical layer configured so as to convert the first light emitted from the light emitting units into a second light of a first color according to a wavelength of the first light emitted from the light emitting units; and a second optical filter layer disposed between the character key plates of the first key buttons and the light guide plate and configured to block the second light of the first color and transmits light having other wavelengths.

2. The keypad assembly of claim 1, wherein the second optical filter layer includes a mixture of inorganic particles absorbing violet-wavelength light and white inorganic particles.

3. The keypad assembly of claim 2, wherein the second optical filter layer includes a mixture of titanium oxide ($TiO_2$) and bismuth trioxide ($Bi_2O_3$).

4. The keypad assembly of claim 3, wherein the mixture has a composition ratio of titanium oxide ($TiO_2$):bismuth trioxide ($Bi_2O_3$) in a range of about 1:1 to about 1:8.

5. The keypad assembly of claim 4, wherein the second optical filter layer has a thickness of 30 microns (μm) or more when the composition ratio is about 1:1.

6. The keypad assembly of claim 2, wherein each of the light emitting units comprises:

a first light emitting unit emitting light having a center wavelength in a range of about 370 nanometers (nm) to about 450 nanometers (nm); and a second light emitting unit emitting white light.

7. The keypad assembly of claim 6, wherein the first light emitting unit emits light having a center wavelength in a range of about 400 nm to about 420 nm.

8. The keypad assembly of claim 6, wherein the first optical filter layer includes red (R), green (G), and blue (B) phosphors, the first optical filter layer emitting light of the first color by a combination of the red (R), green (G), and blue (B) phosphors in response to the first light emitted from the first light emitting unit and the first optical filter layer emitting white light in response to white light emitted from the second light emitting unit.

9. The keypad assembly of claim 6, wherein the second optical filter layer is configured to block violet light emitted from the first light emitting unit so as to not illuminate the character key plates of the first key buttons, and transmit white light emitted from the second light emitting unit so as to illuminate the character key plates of the first key buttons with the white light.

10. The keypad assembly of claim 6, further comprising:

a plurality of second key buttons disposed on the top surface of the light guide plate, each of the second key buttons including a special key plate;

a plurality of second reflection patterns disposed on the light guide plate and configured so as to reflect light toward the second key buttons;

a plurality of second protrusions disposed under the second reflection patterns; and a third optical filter layer disposed between the second key buttons and the light guide plate, the third optical layer configured so as to convert the first light emitted from the light emitting units into a third light of a second color according to a wavelength of the first light emitted from the light emitting units.

11. The keypad assembly of claim 10, wherein the second optical filter layer is configured to block violet light emitted from the first light emitting unit so as to not illuminate the character key plates of the first key buttons, and transmit white light emitted from the second light emitting unit so as to illuminate the character key plates of the first key buttons with the white light.

12. A method of illuminating a keypad assembly for electronic equipment, the method comprising:

generating a first light of a plurality of light emitting units of the keypad assembly;

guiding the first light through a light guide plate and toward a plurality of key buttons of the keypad assembly, each of the key buttons including a first image plate and a second image plats;

a first reflection pattern reflecting the guided light toward the key buttons of the keypad assembly, the first reflection patterns disposed on the light guide plate and corresponding to the key buttons;

a first optical layer converting the first light to a second light of a first color according to a wavelength of the first light generated, the first optical layer being disposed between the first image plates and the light guide plate of the keypad assembly; and a second optical filter layer blocking the second light of the first color and transmitting light having other wavelengths, the second optical filter layer being disposed between the second image plates and the light guide plate of the keypad assembly.

13. The method of claim 12, wherein each of the light emitting units comprises:

a first light emitting unit emitting light having a center wavelength in a range of about 370 nanometers (nm) to about 450 nanometers (nm); and a second light emitting unit emitting white light.

14. The method of claim 13, wherein the second optical filter layer is configured to block violet light emitted from the first light emitting unit so as to not illuminate the second image plates of the key buttons, and transmit white light emitted from the second light emitting unit so as to illuminate the second image plates of the key buttons with the white light.

15. A method of forming a keypad assembly of an electronic equipment, the method comprising:

disposing a plurality of light generating units at an incident side of a light guide plate, the light generating units emitting a first light;

disposing a plurality of first key buttons on a top surface of the light guide plate, each of the first key buttons including a first image plate and a second image plate;

forming a first reflection pattern on the light guide plate and corresponding to each of the first key buttons;

disposing a first optical layer between each of the first image plates of the first key buttons and the light guide plate, the first optical layer being configured to convert the first light emitted from the light generating units into a second light of a first color according to a wavelength of the first light; and disposing a second optical layer between each of the second image plates of the first key buttons and the light guide plate, the second optical layer being configured to block the second light of the first color and transmit light having other wavelengths.

16. The method of claim 15, wherein each of the light generating units comprises:

a first light emitting unit emitting light having a center wavelength in a range of about 370 nanometers (nm) to about 450 nanometers (nm); and a second light emitting unit emitting white light.

17. The method of claim 16, wherein the second optical filter layer is configured to block violet light emitted from the first light emitting unit so as to not illuminate the second image plates of the key buttons, and transmit white light emitted from the second light emitting unit so as to illuminate the second image plates of the key buttons with the white light.

18. The method of claim 16, further comprising:

disposing a plurality of second key buttons on the top surface of the light guide plate, each of the second key buttons including a third image plate;

forming a second reflection pattern on the light guide plate and corresponding to each of the second key buttons; and disposing a third optical layer between each of the third image plates of the second key buttons and the light guide plate, the third optical layer being configured to convert the first light emitted from the light generating units into a third light of a second color according to a wavelength of the first light.

19. The method of claim 18, wherein the second optical filter layer is configured to block violet light emitted from the first light emitting unit so as to not illuminate the second image plates of the first key buttons and the third image plates of the second key buttons, and transmit white light emitted from the second light emitting unit so as to illuminate the second image plates of the first key buttons with the white light.

20. A keypad assembly for electronic equipment, the keypad assembly comprising:

a keypad;

light emitting units which each emit light of a different color and are selectively turned on to illuminate the keypad;

a light guide plate which guides the light emitted;

a plurality of key buttons disposed above the light guide plate; and a plurality of optical filter layers each corresponding to a respective key button and disposed between the respective key button and the light guide plate and which selectively receive or block the light emitted and transmits light having different wavelengths from each other depending on a state of the electronic equipment.

* * * * *